United States Patent [19]

Yamashita

[11] Patent Number: 4,827,582

[45] Date of Patent: May 9, 1989

[54] APPARATUS FOR REMOVING WASTE ROVINGS FROM ROVING BOBBINS

[75] Inventor: Osamu Yamashita, Kanazawa, Japan

[73] Assignee: Murao Boki Kabushiki Kaisha, Kanazawa, Japan

[21] Appl. No.: 94,877

[22] Filed: Sep. 10, 1987

[30] Foreign Application Priority Data

Sep. 12, 1986 [JP] Japan ..... 61-216864

[51] Int. Cl.[4] ..... B65H 73/00

[52] U.S. Cl. ..... 28/293

[58] Field of Search ..... 28/293, 294

[56] References Cited

U.S. PATENT DOCUMENTS 2,670,521 3/1954 Turley ..... 28/294
3,055,603 9/1962 DeFore et al. ..... 28/293 X
3,940,825 3/1976 Murao .

FOREIGN PATENT DOCUMENTS 43-6326 3/1968 Japan ..... 28/294
47-7738 3/1972 Japan ..... 28/294

*Primary Examiner*—Robert R. Mackey
*Attorney, Agent, or Firm*—Oblon, Fisher, Spivak, McClelland & Maier

[57] ABSTRACT

An apparatus for removing waste rovings remaining on roving bobbins, the apparatus comprising a conveyor for transporting roving bobbins huge on hangers, the conveyor including means for effecting the temporary stoppage thereof; a moving frame and a lifting frame which are respectively equipped with upper bobbin holders and lower bobbin holders for maintaining bobbins for rotation; a flocked belt provided between the upper and lower bobbin holders in such a manner that the belt runs tangentially to the bobbins maintained by the upper and lower bobbin holders; and wherein the individual bobbin holders are spaced at intervals corresponding to those of the hangers of the conveyor.

8 Claims, 6 Drawing Sheets

APPARATUS FOR REMOVING WASTE ROVINGS FROM ROVING BOBBINS

BACKGROUND OF THE INVENTION

Field of the Invention

The present invention relates to an apparatus for removing waste rovings staying on the roving bobbins during the returning thereof from a ring spinning frame to a roving frame. More particularly, the present invention relates to an apparatus for removing waste rovings from the roving bobbins by detaching the bobbins from the conveyor, keeping them in rotation and placing them into contact with a running flocked belt so that the waste rovings thereon are removed by friction with the belt.

Background of the Invention

In the spinning process, slivers are drawn and twisted into rovings by a roving frame, which rovings are then wound around roving bobbins (hereinafter referred to merely as bobbins) by a fly frame. The bobbins are sent to a ring spinning frame, whereby the rovings are unwound from the bobbins. Then the vacant bobbins are held by hangers, and returned to the roving frame by a conveyor.

However the ring spinning frame is designed not to draw all the rovings from the individual bobbins so as to avoid a discontinuation thereof possibly occurring in the ring spinning frame, and some portion of rovings are deliberately left behind on the bobbins. Owing to the presence of the rovings remaining on the bobbins, there must be provided a special device whereby the remaining rovings (hereinafter referred to as waste rovings) are removed from the bobbins before they are again sent to the roving frame. Otherwise fresh rovings would be wound around the old rovings on the bobbins.

In order to remove the waste rovings, the common practice is to use a flocked belt running along the conveyor, and the bobbins hung on hangers are kept in contact with the belt to remove the waste rovings by friction with the belt. To achieve this, the hangers must be rotated all the time. However, there is a necessity of employing non-rotary hangers for preventing the rovings from becoming loose during conveyance. Such non-rotary hangers cannot be employed for removing the waste rovings from the bobbins.

OBJECTS AND SUMMARY OF THE INVENTION

The present invention aims at solving the problems pointed out above, and has for its object to provide an apparatus for removing waste rovings from the bobbins with the use of either rotary hangers or non-rotary hangers.

Another object of the present invention is to provide an apparatus for removing waste rovings from the bobbins wherein the rotation of the bobbins is kept at a constant speed unlike the conventional apparatus in which the rotating speed of the bobbins is reduced when required.

A further object of the present invention to provide an apparatus for removing waste rovings from the bobbins, the apparatus being readily built in the conveyor line.

Other objects and advantages of the present invention will become more apparent from the following detailed description, when taken in conjunction with the accompanying drawings which show, for the purpose of illustration only, one embodiment in accordance with the present invention.

According to the present invention, there is provided an apparatus for removing waste rovings staying on the bobbins, the apparatus comprising a conveyor for transporting roving bobbins hung on hangers, the conveyor including means for effecting the temporary stoppage thereof; a moving frame and a lifting frame which are respectively equipped with upper bobbin holders and lower bobbin holders for maintaining rotating bobbins; a flocked belt provided between the upper and lower bobbin holders in such a manner that the belt runs tangentially to the bobbins maintained by the upper and lower bobbin holders; and the individual bobbin holders being spaced at intervals corresponding to those of the hangers of the conveyor.

DETAILED DESCRIPTION OF THE PREFERRED EMBODIMENT

Figure 1:
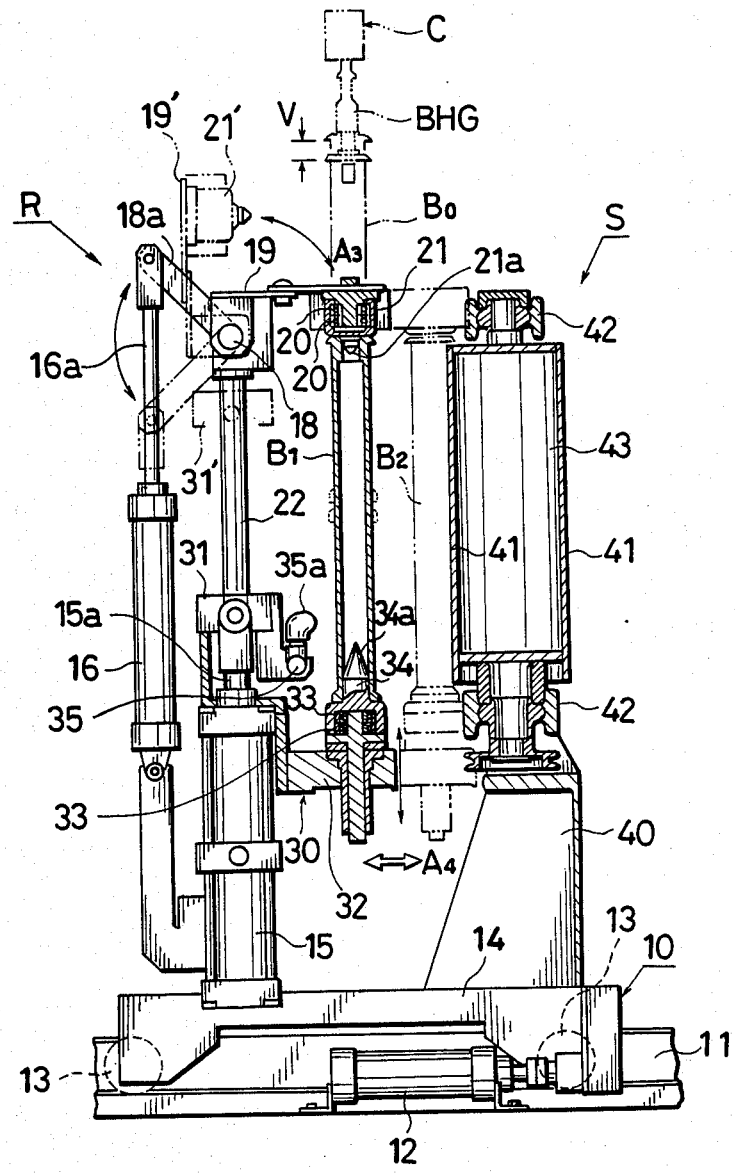
FIG. 1 is a diagrammatic end view showing an apparatus embodying the present invention.
Figure 2:
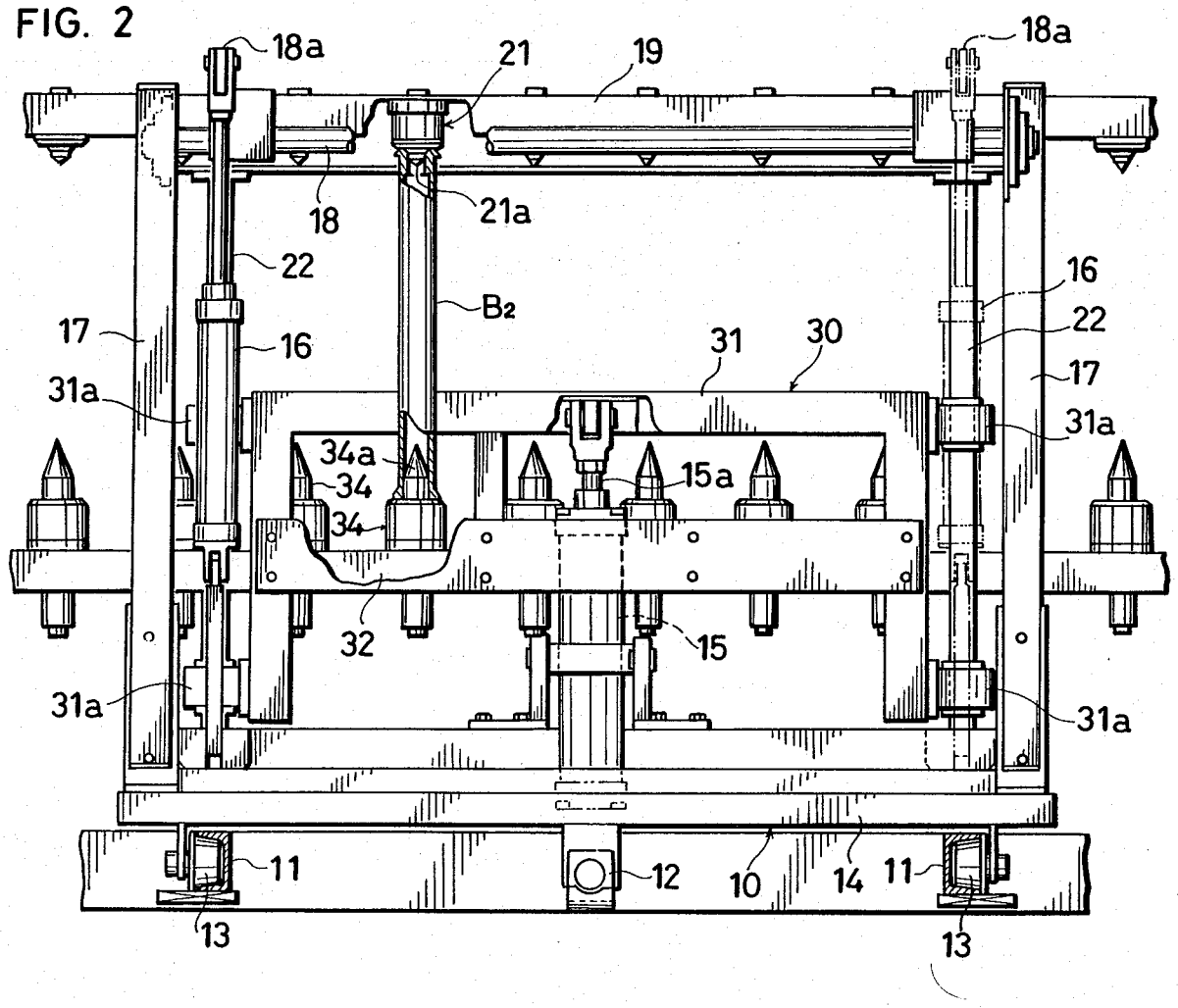
FIG. 2 is a left side view, partly broken, showing the apparatus of FIG. 1.
Figure 3:
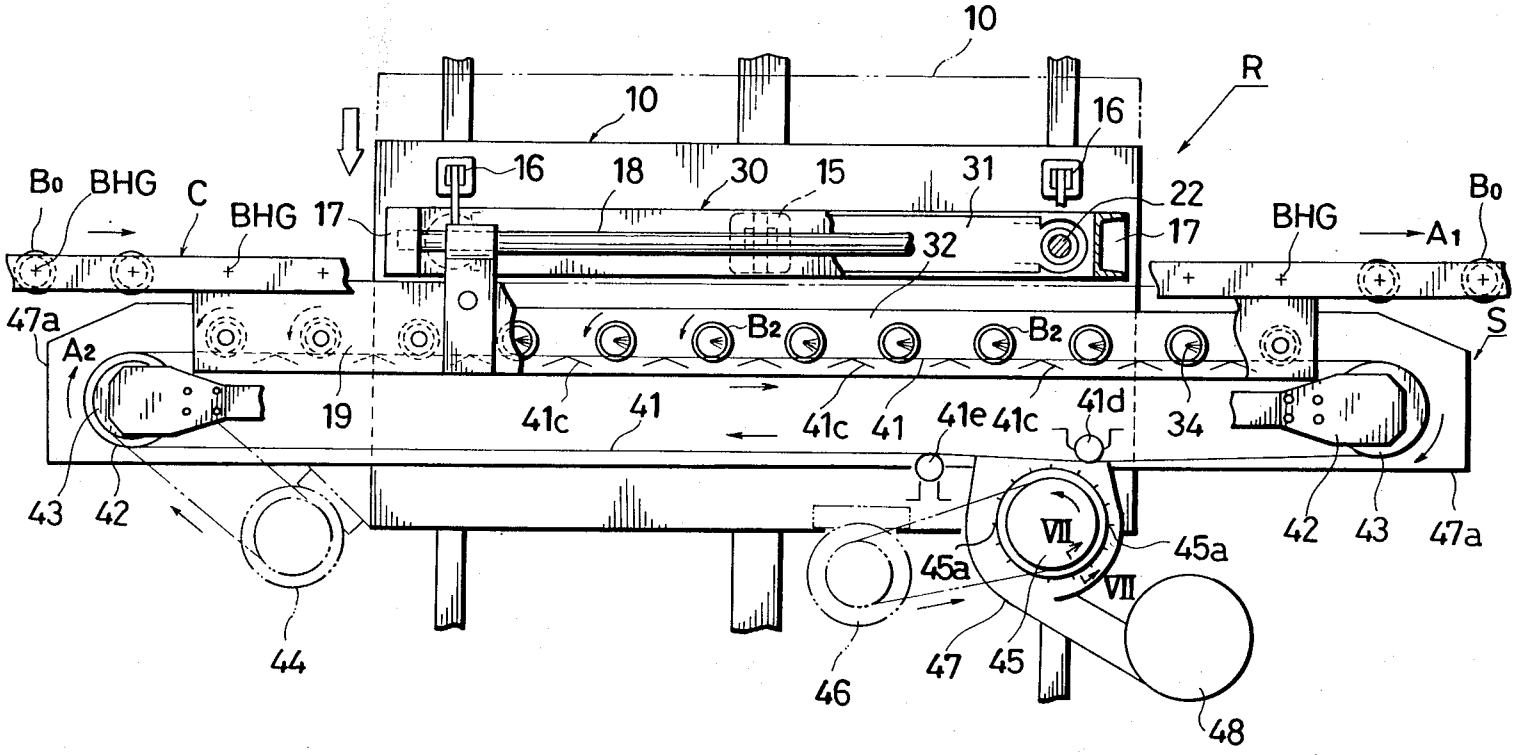
FIG. 3 is a plan view, partly broken, showing the apparatus of FIG. 1.

Referring to FIGS. 1 to 3, the apparatus of the present invention is provided along a conveyor (C) for transporting roving bobbins. The apparatus includes a bobbin holding section (R) and a belt running section (S). The bobbin holding section (R) includes a moving frame 10, an lifting frame 30 adapted to move up and down, lower bobbin holders 34 and upper bobbin holders 21.

Roving bobbins $B_0$ are hung on hangers BHG at equal distances, and transported in the direction of arrow $A_1$ (FIG. 3). The hangers BHG are individually constructed so that they maintain the bobbins when the bobbins are inserted from below whereas the bobbins are released from the hangers when the bobbins are slightly raised upward and then pulled downward. The reference characters $B_0$ indicates the bobbins hung on the hangers. The moving frame 10 includes a body structure 14 and wheels 13 carried thereon. The wheels find themselves in channels 11. The body structure 14 is provided with a pneumatic cylinder 12 whose one end is fixed to a base plate, thereby enabling the body structure 14 to move toward and from the conveyor (C).

The lifting frame 30 is caused to move up and down above the body structure 14 by means of a pneumatic cylinder 15. The lifting frame 30 includes a framework 31, and is slidably supported by guide rods 22 through brackets 31*a*, wherein the guide rods 22 are upright fixed to the body structure 14. The framework 31 is provided with a projecting bracket 32 in its middle portion. The projecting bracket 32 carries lower bobbin holders 34 spaced corresponding to the intervals of the bobbin hangers BHG. The lower bobbin holders 34 are rotatably connected to the bracket 32 through bearings 33, and each have conically shaped tops 34*a*.

The guide rods 22 have bearings for supporting a rotating shaft 18 in their upper section, which rotating shaft 18 has an arm 18*a* and a rotary bracket 19. The arm 18*a* is pivotally connected to a pneumatic cylinder 16 at its one end, and the pneumatic cylinder 16 is connected to the body structure 14. The rotary bracket 19 is provided with upper bobbin holders 21 spaced corresponding to the intervals of the lower bobbin holders 34. The upper bobbin holders 21 are rotatively supported on the rotary bracket 19 through bearings 20, and each have sharpened heads 21*a* so as to facilitate the insertion thereof into the open ends of the roving bobbins. In FIG. 3, twelve lower bobbin holders 34 and twelve upper bobbin holders 21 are provided in alignment in the same vertical plane.

Figure 7:
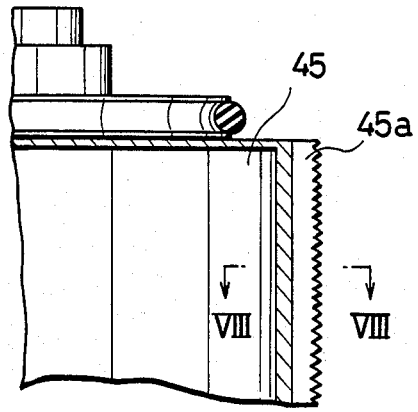
FIG. 7 is a fragmentary cross-sectional view taken along the VII—VII line in FIG. 3.
Figure 8:
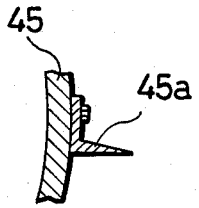
FIG. 8 is a fragmentary cross-sectional view taken along the VIII—VIII line in FIG. 7.

In the belt running section (S) an endless flocked belt 41 is arranged alongside the upper bobbin holders 21 and the lower bobbin hangers 34. The flocked belt 41 runs on wheels 43, which are rotatably supported on brackets 42. One of the wheels 43 (In FIG. 3, the left-hand wheel) is connected to a motor 44 through a drive belt, and rotated in the direction of arrow $A_2$. There is provided a cylindrical toothed wheel 45, commonly called a comb wheel, behind the flocked belt 41, near the running path of the bobbins $B_0$. The toothed wheel 45 is driven by a motor 46, wherein the toothed wheel 45 is rotated at a higher speed than the running speed of the flocked belt 41. The toothed wheel 45 is covered with a cover 47. A fan 48 is provided to collect fibrous dust within the cover 47. As shown in FIGS. 7 and 8, the toothed wheel 45 is provided with a number of teeth 45*a*. Guide members 41*c* are provided for securing smooth contact between the belt 41 and the bobbins $B_2$ ($B_2$ denotes bobbins kept in contact with the flocked belt 41). The reference numerals 41*d* and 41*e* denote guide pulleys for regulating the contact between the flocked belt 41 and the toothed wheel 45.

Figure 5:
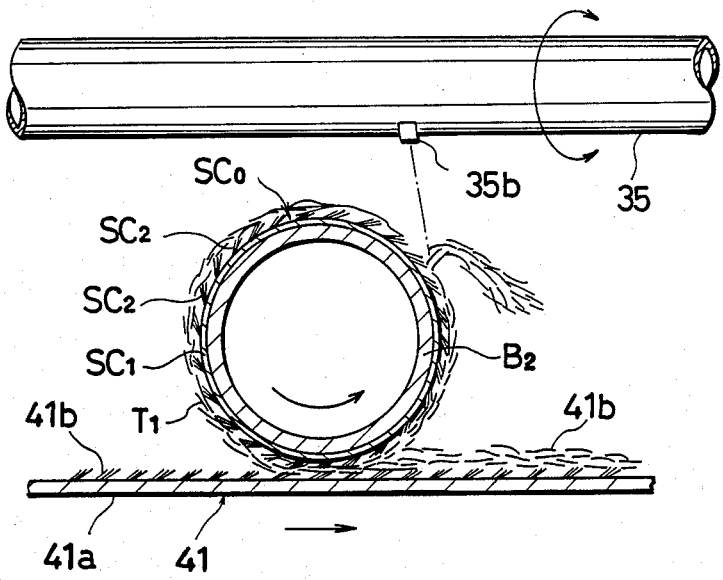
FIG. 5 is a view explaining the removal of waste rovings in the area of the bobbin where a sticking cloth is provided.
Figure 6:
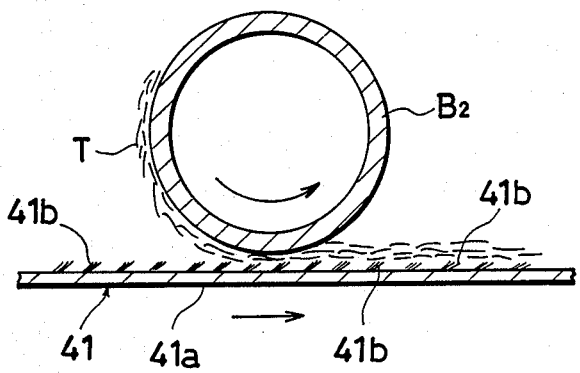
FIG. 6 is a view explaining the removal of waste rovings from the bobbin by a flocked belt.

The flocked belt 41 has substantially the same structure as that of a sticking cloth $SC_0$; in common with them, flocks 41*b* are planted on a base cloth 41*a*, wherein the flocks are inclined in the running direction of the base cloth 41*a* (FIGS. 5 and 6). The running direction of the base cloth 41*a* is arranged to be the same as the direction in which the bobbins $B_2$ are rotated so as to unwind the waste rovings (T) thereon.

In operation, the moving frame 10 is withdrawn by the action of the pneumatic cylinder 12, and the upper bobbin holders 21 are maintained at positions 21' (FIG. 1). The lifting frame 30 is descended.

The bobbins $B_0$ are conveyed by the conveyor (C), and when they come above the respective lower holders 34 the conveyor (C) is automatically stopped in the known manner, such as by the use of a limit switch. The lifting frame 30 is raised by the action of the pneumatic cylinder 15, thereby causing the conically shaped tops 34*a* of the individual bobbin holders 34 to insert into the respective open bottom ends of the bobbins $B_0$. The lifting frame 30 is further raised by a distance (V) so that the bobbins $B_0$ are dismounted from the hangers BHG. The bobbins free from the hangers are held upright on the lower bobbin holders 34, and caused to descend as shown in FIG. 1. Hereinafter the bobbins in this state will be denoted by the reference chracters $B_1$.

Then the pneumatic cylinder 16 is operated to rotate the rotary shaft 18 at about 90°, and causes the upper bobbin holders 21 to rotate together with the rotary bracket 19 in the direction of arrow $A_3$, thereby enabling the sharpened heads 21*a* of the upper holders 21 to insert into the respective open top ends of the respective bobbins $B_1$. In this way, the bobbins are maintained in vertical postures between the upper and lower bobbin holders 21, 34 in a rotative manner. Then the pneumatic cylinder 12 is operated to move the moving frame 10 in the direction of arrow $A_4$ until the bobbins $B_2$ come into contact with the flocked belt 41. The bobbins $B_2$ are caused to rotate by friction with the running flocked belt 41 in a direction in which the waste rovings (T) are unwound (FIG. 6). Since the flocks 41*b* planted on the base cloth of the belt are inclined in the running direction of the belt 41, the waste rovings (T) are smoothly unwound, and taken away by the running belt 41.

Figure 4:
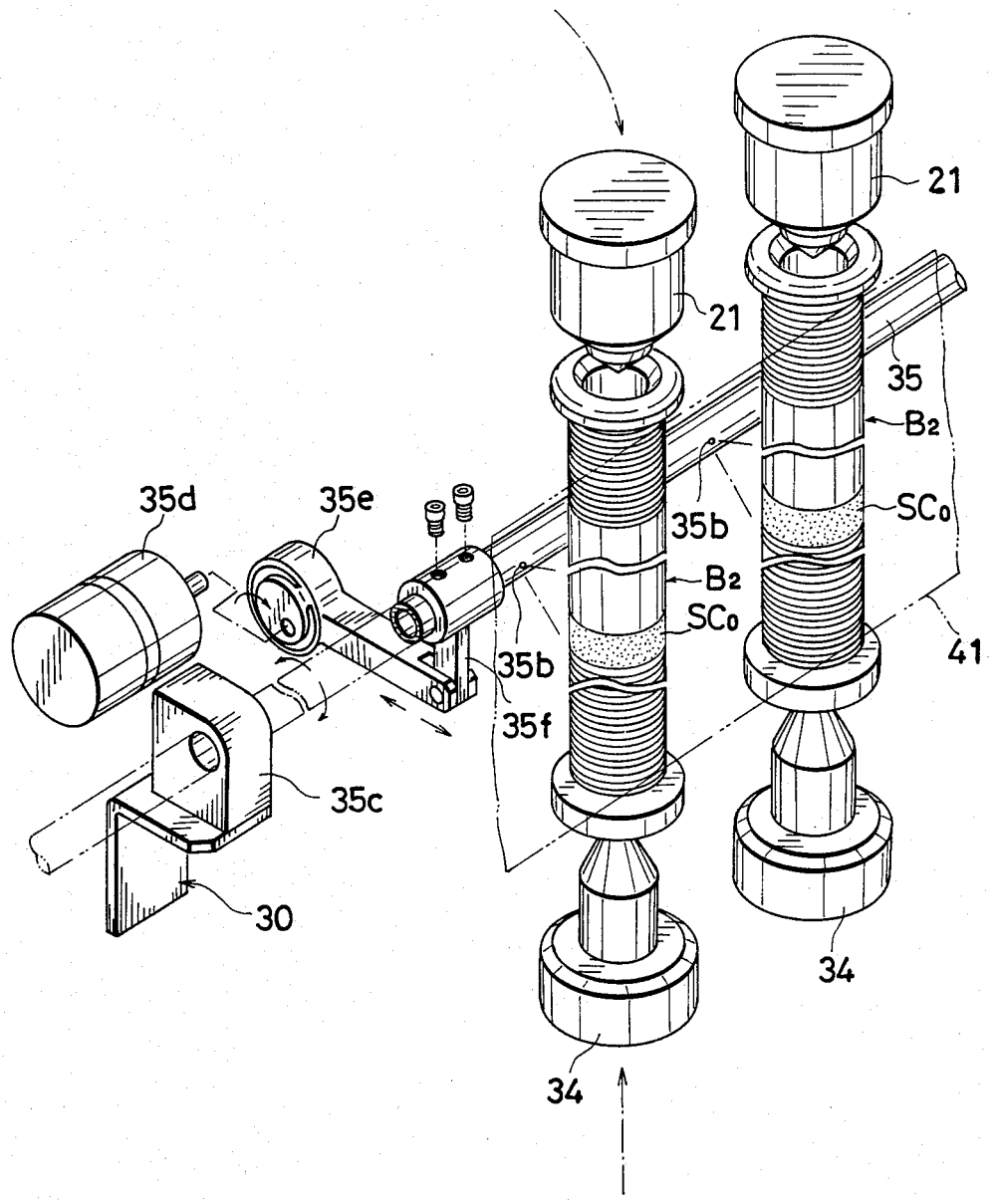
FIG. 4 is a view explaining the operation of removing waste rovings from the bobbins.

Almost all the rovings are taken away by the flocked belt 41, but it sometimes happens that they remain in the neighborhood of the sticking cloth $SC_0$ (FIGS. 4 and 5). The sticking cloth $SC_0$ is intended to secure an end of the roving at which the winding thereof starts, and is made up of a base cloth $SC_1$ and flocks $SC_2$ planted thereon, wherein the base cloth is wound around the upper portion and the lower portion of the individual bobbins.

It is necessary to remove the rovings staying in the sticking cloth $SC_0$. To this end, the lifting frame 30 is provided with an air pipe 35, which has several nozzles 35*b* adapted to eject air tangentially to the bobbins $B_2$. As shown in FIG. 4, the air pipe 35 is rotatably supported by bearings 35*c*, and is moved up and down so as to correspond to the position of the sticking cloth $SC_0$ by means of a motor 35*d*, and eccentric disc mechanism 35*e*. The flocks $SC_2$ of the sticking cloth $SC_0$ are blown in their inclining direction by air through the nozzles 35*b*.

In this way part of the rovings ($T_1$) staying on the sticking cloth is peeled off by the air ejected through the nozzle 35*b*. As described above the air pipe 35 is maneuvered so that the nozzles 35*b* are directed to cover the entire width of the sticking cloth. Thus all the rovings staying on the sticking cloth $SC_0$ are removed.

The rovings ($T_1$) peeled off from the bobbins $B_2$ stick to the flocks of the belt 41, and are taken away as a fibrous waste, which is picked up by the toothed wheel 45, and discharged outside under suction provided by the fan 48.

After the removal of rovings from the bobbins $B_2$ is finished, the moving frame 10 is returned by the pneumatic cylinder 12, and the upper bobbin holders 21 are upwardly withdrawn by the pneumatic cylinders 16. Then the lifting frame 30 is raised by the pneumatic cylinder 15 to enable the bobbins to ascend until their top open ends are inserted into the hangers BHG. In this way, all the bobbins are hung on the hangers BHG in a single operation.

As the procedure for hanging the bobbins on the hangers, the first step is to cause the lifting frame 30 to descend, and the second step is to cause the conveyor (C) to advance. The third step is to transport the bobbins $B_0$ to above the respective bobbin holders on the lifting frame. This procedure is repeated.

As described above, according to the present invention there are provided a moving frame and a lifting frame which are respectively equipped with mutually mating bobbin holders. Additionally, a flocked belt is provided between the upper and lower bobbin holders in such a manner that the belt runs tangentially to the respective bobbins, and a toothed wheel is provided in contact with the flocked belt. The individual bobbin holders are spaced at intervals corresponding to those of bobbin hangers on the conveyor. Under this arrangement, when the moving frame is advanced, the bobbins come into contact with the flocked belt, and when the lifting frame is operated the bobbins are dismounted from the hangers. A single operation of the lifting frame completes the mounting and dismounting of the bobbins on and from the hangers. Accordingly, the system can be readily built in the conveyor line from the ring spinning frame to the roving frame.

After the bobbins are released from the hangers the waste rovings are removed therefrom, thereby eliminating the necessity of employing rotary hangers as is practised under the conventional system for removing waste rovings.

What I claim:

1. An apparatus for removing waste rovings remaining on roving bobbins, the apparatus comprising:

a conveyor for transporting roving bobbins hung on hangers, the conveyor including means for effecting the temporary stoppage thereof;

a moving frame and a lifting frame which are respectively equipped with upper bobbin holders actuatable so as to selectively secure and release a bobbin, and lower bobbin holders for maintaining rotating bobbins;

means for moving the lifting frame between a lower position and an upper position for loading and receiving roving bobbins from said conveyor, and from said upper position back to said lower position, when said conveyor is stopped;

means for actuating said upper bobbin holders so as to selectively secure and release the bobbins;

a flocked belt provided between the upper and lower bobbin holders in such a manner that the belt runs tangentially to the bobbins maintained by the upper and lower bobbin holders;

means for moving said moving frame between a position such that the bobbins are adjacent the flocked belt and another position such that the bobbins are spaced from the flocked belt; and means for driving the flocked belt so as to remove the rovings from the bobbins when the moving frame is at a position such that the bobbins are adjacent the flocked belt;

wherein the individual bobbin holders are spaced at intervals corresponding to those of the hangers of the conveyor.

2. An apparatus as defined in claim 1, wherein the upper bobbin holders and the lower bobbin holders each are in alignment in the same vertical plane, wherein each holder has a converging end toward the bobbins.

3. An apparatus as defined in claim 1, wherein the moving frame includes a guide rod upright fixed thereto for allowing the lifting frame to move thereon in an up and down manner, wherein the lifting frame is connected to the moving frame by means of a pneumatic cylinder.

4. An apparatus as defined in claim 1, wherein the moving frame includes rotary wheels located in channels produced in a base body, and a pneumatic cylinder connected to the base body.

5. An apparatus as defined in claim 1, wherein the flocked belt includes an endless base cloth and flocks planted thereon, wherein the flocks are inclined in a running direction of the belt.

6. An apparatus as defined in claim 1, wherein the lifting frame includes an air pipe provided alongside the lower bobbin hangers, the air pipe including nozzles adapted to eject air jets toward a section where a sticking cloth is provided on the bobbins.

7. The apparatus as defined in claim 6 including means for oscillating said air pipe, said means for oscillating comprising:

a pivot arm mounted to said air pipe;

an eccentric disc connected to said pivot arm; and motor means for driving said eccentric disc so as to pivot said pivot arm, whereby said air pipe is oscillated.

8. An apparatus as defined in claim 1 including:

a pneumatic cylinder mounted to said moving frame;

a pivot shaft mounted to the rod of said pneumatic cylinder;

a bracket pivotally mounted to said pivot shaft; and bearing means for rotatably supporting said upper bobbin holders on said bracket.

* * * * *